United States Patent [19]

Imamura

[11] Patent Number: 4,942,908

[45] Date of Patent: Jul. 24, 1990

[54] WARP TRANSFER CONTROL SYSTEM OF LOOM FOR FILLING DENSITY CHANGE

[75] Inventor: Shuichiro Imamura, Tokyo, Japan

[73] Assignee: Nissan Motor Co., Ltd., Yokohama, Japan

[21] Appl. No.: 329,987

[22] Filed: Mar. 29, 1989

[30] Foreign Application Priority Data

Mar. 29, 1988 [JP] Japan ..... 63-75306

[51] Int. Cl.[5] ..... D03D 49/04

[52] U.S. Cl. ..... 139/99; 139/110; 139/309; 139/311; 139/1 E

[58] Field of Search ..... 139/109, 99, 110, 309, 139/311, 1 E; 66/210

[56] References Cited

U.S. PATENT DOCUMENTS 4,480,665 11/1984 Imamura et al. ..... 139/110 X
4,605,044 8/1986 Sakano ..... 66/210
4,619,294 10/1986 Sainen et al. ..... 139/99
4,817,677 4/1989 Deconinck et al. ..... 139/99

FOREIGN PATENT DOCUMENTS 61-16382 1/1986 Japan .
2263347 11/1987 Japan ..... 139/309
3288246 11/1988 Japan ..... 139/99

*Primary Examiner*—Andrew M. Falik
*Attorney, Agent, or Firm*—Foley & Lardner, Schwartz, Jeffery, Schwaab, Mack, Blumenthal & Evans

[57] ABSTRACT

A warp transfer control system for a loom, includes a first actuator for varying a warp let-off speed, a second actuator for varying a fabric take-up speed to change a filling density, and a control unit which has a take-up control section for controlling the second actuator, a feedback control section for controlling the let-off speed through the first actuator when no change is required in the filling density, and a feedforward control section for changing the let-off speed so as to improve an appearance quality of a fabric when the density is changed. When a change from a first filling density to a second density is required, the feedforward section first changes the let-off speed excessively from a first let-off speed corresponding to the first density beyond a second let-off speed corresponding to the second density, and holds the let-off speed at such an excessive level for a limited duration.

9 Claims, 4 Drawing Sheets

WARP TRANSFER CONTROL SYSTEM OF LOOM FOR FILLING DENSITY CHANGE

BACKGROUND OF THE INVENTION

The present invention relates to a warp transfer control system of a loom which can change a filling density of a woven fabric during a normal weaving operation, and more specifically to a warp transfer control system for controlling a warp let-off rate and a fabric take-up rate so as to improve an appearance quality of a boundary between two fabric portions having different filling densities.

Japanese Utility Model Provisional Publication No. 61-16382 shows a conventional control system having a servomotor for driving a warp beam and another servomotor for driving a surface roller. When a change of a fabric density is required, this control system controls the servomotor for the warp beam directly by an output signal of a warp tension sensor without using an integrating circuit, to prevent occurrence of a weaving bar. However, this system is still unable to improve a fabric quality to a sufficient level to meet a recent demand for higher fabric quality.

SUMMARY OF THE INVENTION

It is an object of the present invention to provide a warp transfer control system and a warp transfer control method which can change the filling density of a fabric in such a manner as to improve the fabric quality.

According to the present invention a control system of a loom comprises a warp transfer means, a command means and a control means.

The warp transfer means is a means for transferring warp yarns at a controlled warp transfer rate in the loom. The command means is a means for commanding a change of the warp transfer rate from an initial level to a final level. The control means is a means for controlling the warp transfer rate by sending a transfer control signal to the warp transfer means. The control means comprises a first controlling means for changing the transfer rate from the initial level to an excessive level beyond the final level when the change is commanded by the command means. Preferably, the first controlling means holds the transfer rate equal to the excessive level for a predetermined limited time.

FIG. 4 shows one example of the basic arrangement of the control system. In this example, the warp transfer means 101 comprises a warp let-off means 101*a* including a first drive means for varying a warp let-off rate, and a fabric take-up means 101*b* including a second drive means for changing a fabric take-up rate to change a filling density, and the control means 103 comprises a feedforward controlling means 103*a* constituting the first controlling means, a feedback controlling means 103*b* connected with a first sensing means 104 for sensing an actual warp tension, and a take-up control means 103*c* for controlling the fabric take-up rate. The command means 102 is connected with a second sensing means 105 for counting a number of picks. The warp transfer means 101 is arranged to weave a fabric in cooperation with a weft inserting means 106.

DETAILED DESCRIPTION OF THE INVENTION

Figure 1:
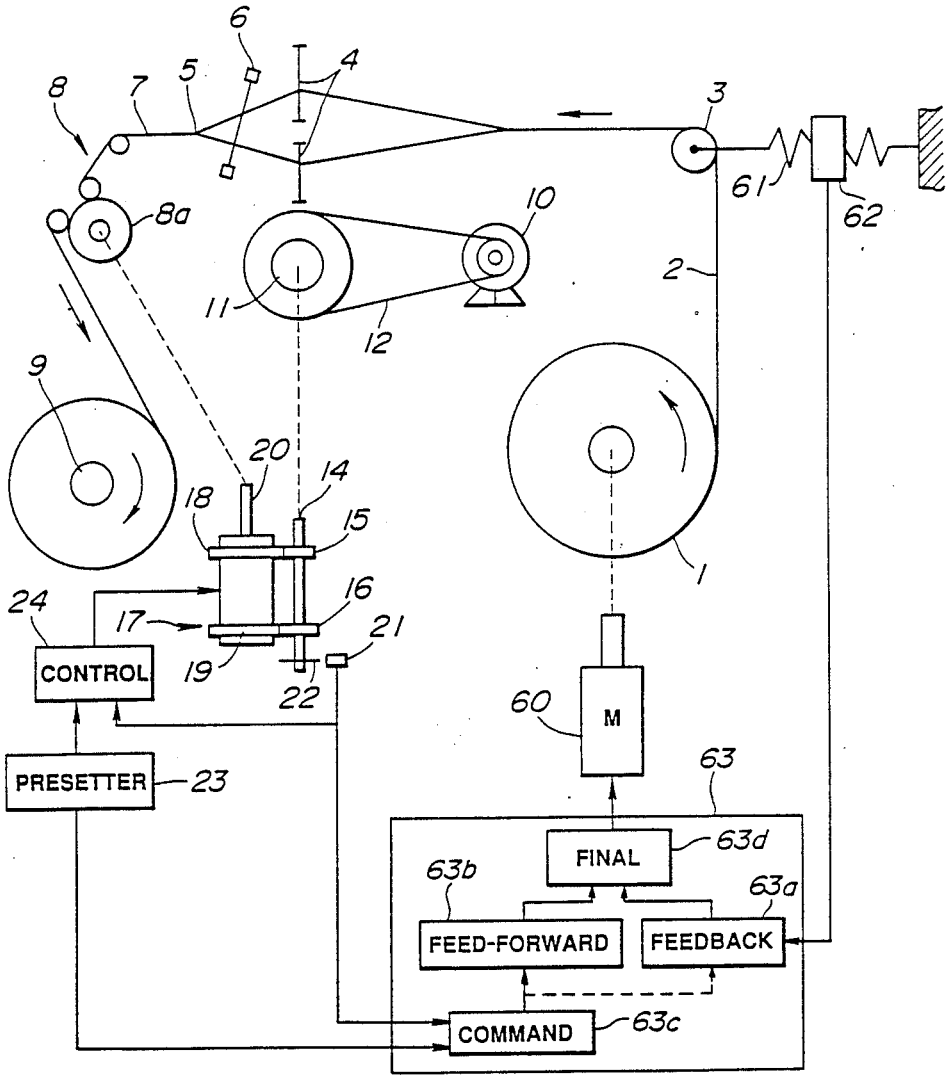
FIG. 1 is a schematic view of a loom having a control system according to one embodiment of the present invention.
Figure 2:
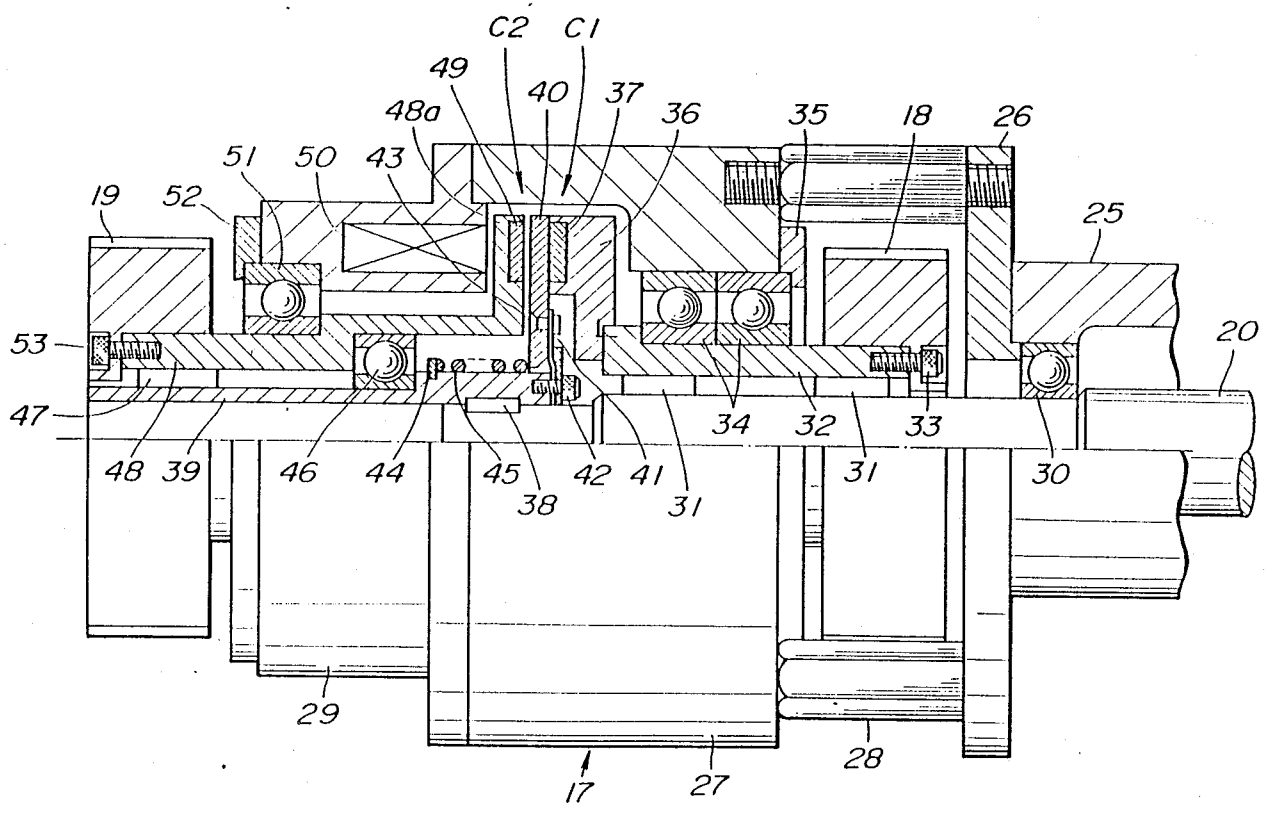
FIG. 2 is an enlarged sectional view of a speed change device shown in FIG. 1.
Figure 3:
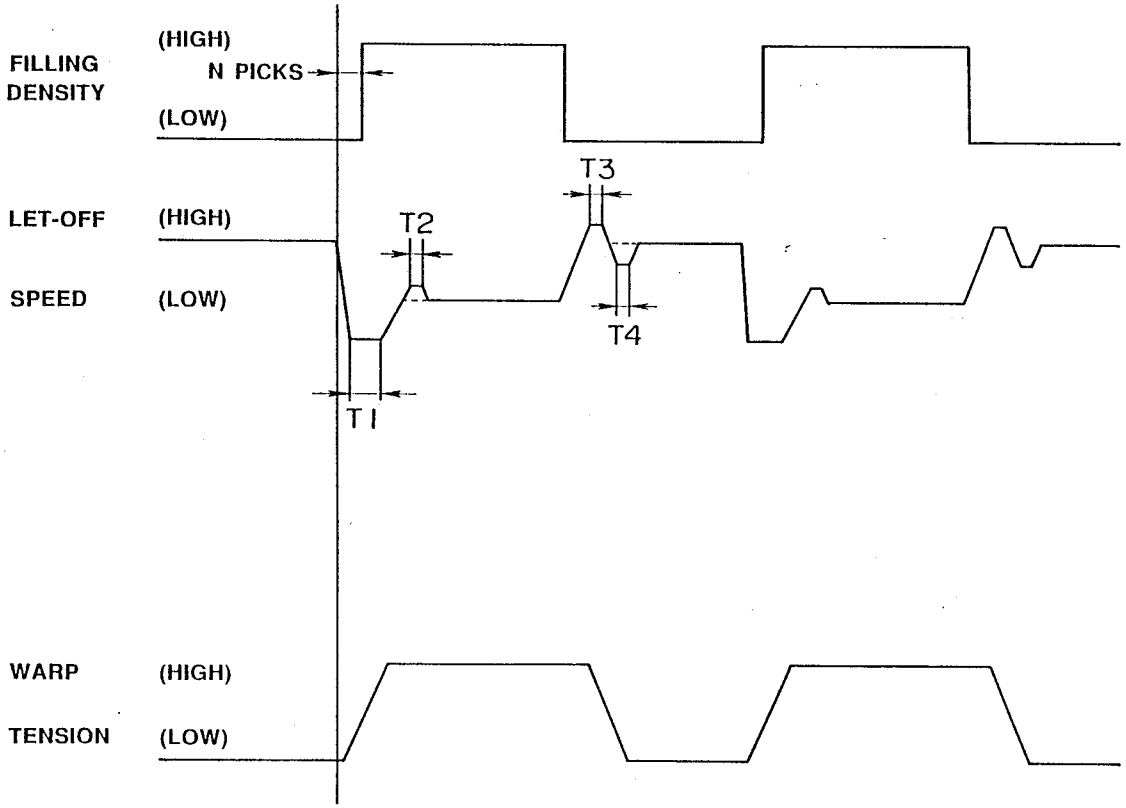
FIG. 3 is a time chart showing changes in signals in the control system shown in FIG. 1.
Figure 4:
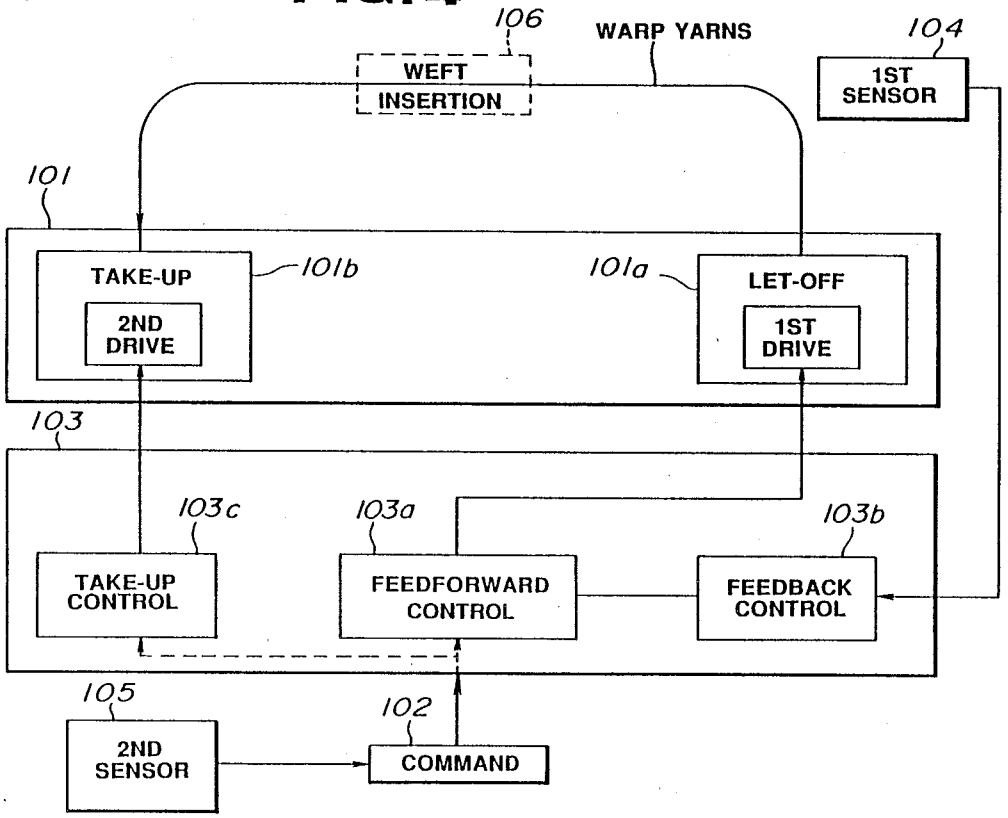
FIG. 4 is a block diagram showing one example of a basic arrangement of the present invention.

One embodiment of the present invention is shown in FIGS. 1–3.

A loom shown in FIG. 1 has a warp beam 1, a warp yarns 2, a back roller 3, a heald unit 4, a cloth fell 5, a reed 6, a woven fabric 7, a weaving density adjusting device 8 including a surface roller 8*a*, a cloth roller 9, a main motor 10, and a loom main shaft 11. The main shaft 11 is driven by the motor 10 through a belt 12. The heald unit 4 is connected with the main shaft 11 through a shedding mechanism, and operated at a predetermined speed. The reed 6 is connected with the main shaft 11 through a beating mechanism, and operated at a predetermined speed. The weaving density adjusting device 8 and the cloth roller 9 are also connected with the main shaft 11 through a fabric take-up mechanism. The loom of this embodiment is arranged to change the filling density by changing the fabric take-up speed while holding the weft inserting rate constant.

In this embodiment, the weaving density adjusting device 8 is connected with the main shaft 11 by a drive system including a speed change gear system 17. A drive shaft 14 is connected with the main shaft 11 so that the drive shaft 14 rotates with the main shaft 11 as a single unit. Gears 15 and 16 having different numbers of teeth are fixedly mounted on the drive shaft 14. The gears 15 and 16 are engaged, respectively, with gears 18 and 19 of the speed change gear system 17. The gear system 17 further includes an output driven shaft 20 connected with the surface roller 8*a* of the weaving density adjusting device 8. There is further provided a proximity switch 21 for producing a pulse signal each time an element fixed to the shaft 14 assumes a predetermined angular position confronting the proximity switch 21.

There are further provided a pattern presetter 23 and a take-up control unit 24 for controlling a filling density. The pattern presetter 23 stores a preset pattern of the filling density of a fabric. The contol unit 23 is connected with the pattern presetter 23 and the proximity switch 21 and arranged to produce a take-up speed control signal in accordance with the preset pattern. For example, the take-up control signal is held equal to a first signal value representing a first take-up speed, for a first time duration required for a predetermined first number N1 of revolutions of the main shaft 11. Then, the take-up control signal is changed from the first signal value to a second signal value representing a second take-up speed value, and held equal to the second signal value for a predetermined second time duration corresponding to a predetermined second number N2 of revolutions of the main shaft 11. The take-up control unit 24 controls the fabric take-up speed by sending the take-up control signal to the gear system 17.

FIG. 2 shows the speed change gear system 17 of this embodiment. The gear system 17 includes a tubular member 25 connected with a frame of the loom, a circular plate 26 fixed to the tubular member 25, a $ hollow cylindrical case 27 connected with the circuit plate 26 by a plurality of connecting members 28, and a hollow cylindrical case 29 connected with the case 27. The output shaft 20 is rotatably supported by a bearing 30 in the tubular member 25. The output shaft 20 extends through the case 27, and reaches a position in the case 29.

A hollow shaft 32 is rotatably mounted on the output shaft 20 through one or more bearings 31. The gear 18 for a low speed is mounted on the hollow shaft 32, and fixed to this shaft 32 by bolts 33. Bearings 34 are disposed between the outer surface of the hollow shaft 32 and the case 27. An outer race member of the bearing 34 is confined in a position by a cap plate 35. A clutch disc 36 is fixed to an end of the hollow shaft 32. The clutch disc 36 has a first friction member 37.

A hollow shaft 39 is connected with the end portion of the output shaft 20 by at least one key 38. A movable clutch plate 30 is attached to the end of the hollow shaft 39 through at least one plate spring 41. An outer end of the plate spring 41 is fixed to the plate 40 by a rivet 43. A stopper ring 44 is fixedly mounted on the hollow shaft 39. A coil spring 45 is disposed between the stopper ring 44 and the movable clutch plate 40, so that the coil spring 45 exerts a biasing force pressing the clutch plate 40 against the first friction member 37.

A hollow shaft 48 is rotatably mounted on the hollow shaft 39 through bearings 46 and 47. The hollow shaft 48 has a clutch disc 48*a* which is an integral part of the shaft 48. A second friction member 49 is fixed to the clutch disc 48*a*. The movable clutch plate 40 is placed between the first friction member 37 fixed to the clutch disc 36, and the second friction member 49. An electromagnet 50 is provided behind the clutch disc 48*a*, within the case 29. The first friction member 37 and the movable clutch plate 40 constitute a first clutch Cl. The clutch plate 40, the second friction member 49 and the electromagnet 50 constitute a second clutch C2. There is further provided a bearing 51 disposed between the outer surface of the hollow shaft 48 and the case 29, and a cap plate 52 retaining the bearing 51. The gear 19 for a high speed is mountd on the projecting end of the hollow shaft 48, and fixed to the hollow shaft 48 by bolts 53.

In this gear system 17, the gears 18 and 19 are engaged, respectively, with the gears 15 and 16 of the drive shaft 14. The number of teeth of the gear 18 is greater than the number of teeth of the gear 19.

When the clutch plate 40 is pressed against the first friction member 37 as shown in FIG. 2, an input torque of the drive shaft 14 is transmitted through the gear 18, and the hollow shaft 39 to the output shaft 20. Therefore, the output shaft 20 causes the surface roller 8*a* to rotate at a low speed.

When the clutch plate 40 is moved, and against the second friction member 49 by the electromagnet 50, then the input torque is transmitted through the gear 19, and the hollow shaft 39 to the output shaft 20. Therefore, the output shaft 20 drives the surface roller 8*a* at a high speed.

As shown in FIG. 1, the warp let-off mechanism comprises a servomotor 60 for driving the warp beam 1. A warp tension sensor 62 is provided between the back roller 3 and a frame of the loom. The warp tension sensor 62 of this embodiment has two detecting elements connected with both ends of the back roller 3 by springs 61, respectively. The warp tension sensor 62 sends a warp tension signal representing a sensed actual warp tension, to a warp let-off control unit 63 for controlling a warp let-off rate by controlling the servomotor 60 in accordance with the warp tension signal. The let-off control unit 63 is further connected with the pattern presetter 23, and arranged to perform a predetermined feedforward control when the filling density is to be changed.

The let-off control unit 63 of this embodiment has a feedback control section 63*a* which is connected with the warp tension sensor 62, and designed to control the warp let-off speed of the warp beam 1 so as to reduce a deviation of the sensed actual warp tension from a predetermined desired warp tension. The let-off control unit 63 of this embodiment further has a feedforward control section 63*b*, and a command section 63*c* which is connected with the pattern presetter 23 and the proximity switch 21. The command section 63*c* preliminarily reads in the stores the preset pattern in a storage device. Each time a change of the filling density is commanded by the preset pattern through the command section 63*c*, the feedforward section 63*b* changes the warp let-off rate forcibly without regard to the warp tension, to a value suitable for a new filling density at a first instant before the take-up control unit 24 changes the filling density by changing the take-up rate at a second instant. An interval between the first and second instants is preliminarily set equal to a time required for a predetermined number N of picks. In this embodiment, the number N of picks is equal to 5 or 6. Therefore, five or six weft insertions are made during the interval from the first instant at which the let-off rate is forcibly changed by the feedforward section 63*b*, to the second instant at which the take-up control unit 24 changes the take-up rate.

At the first instant, the feedforward control section 63*b* of this embodiment changes the let-off rate excessively beyond a theoretical warp let-off rate suited to the new filling density by controlling the servomotor 60. The theoretical let-off rate suited to a filling density is a let-off rate required to obtain a desired warp tension when the fabric take-up rate is held equal to a value corresponding to that filling density. The feedforward section 63*b* holds the warp let-off rate at an excessive level beyond the theoretical rate temporarily for a short time duration by controlling the servomotor 60, and then the feedback control section 63*a* restarts the feedback control. The warp let-off control unit 63 of this embodiment further includes a final control section 63*d* which is connected with the feedback section 63*a* and the feedforward section 63*b*, and arranged to send a final warp let-off rate control signal to the servomotor 60. In response to this control signal, the servomotor 60 rotates the warp beam 1 so as to achieve the let-off rate represented by the control signal. The rotational speed of the servomotor 60 is controlled so that the let-off rate is precisely controlled from the full to the empty beam. The final control section 63*d* is arranged to prevent the feedback control of the feedback control section 63*a* during a limited time duration for each change of the filling density.

FIG. 3 shows operations of the control system of this embodiment.

In this example, the preset pattern of the presetter 23 first commands a change of the filling density from a low value to a high value. In this case, the warp let-off control unit 63 starts decreasing the warp let-off rate to an excessively low value at a first instant, a predetermined time interval prior to an actual change of the filling density. The predetermined time interval is an interval required for the predetermined number N of picks, five or six picks, for example. The excessively low value is a value which is lower than the theoretical let-off speed value corresponding to the high value of the filling density, by a predetermined excess amount. It is preferable that the excess amount is greater than 20 percent of the difference between the theoretical let-off speed value corresponding to the high filling density value and the theoretical let-off speed value corresponding to the low filling density value. Then, the let-off control unit 63 holds the let-off rate equal to the excessively low value for a predetermined first time duration T1. The first time duration T1 of this embodiment is equal to or longer than a time corresponding to one pick, and equal to or shorter than a time corresponding to 5 picks. Therefore, during the first time duration T1, the weft inserting mechanism of the loom performs one or more picks, not more than 5 picks.

At a second instant within the first time duration T1, the fabric take-up control unit 24 changes the take-up rate from a high speed value corresponding to the low filling density value, to a low speed value corresponding to the high density, by bringing the first clutch Cl of the gear system 17 to an engaged state. Therefore, the filling density is increased to the high value at the second instant. However, the let-off rate is still held equal to the excessively low value until the expiration of the first time duration T1. Thus, the control system of this embodiment temporarily increases the tendency toward a higher warp tension by decreasing the let-off rate to the excessively low value. At the end of the first time duration T1, the let-off control unit 63 increases the let-off rate from the excessively low value to a second temporary value which is slightly higher than the theoretical let-off speed value corresponding to the high filling density, and holds the let-off rate equal to the second temporary value for a second short time duration T2. The second temporary value is used to assist the let-off speed to settle down to a new steady-state smoothly. At the end of the second time duration T2, the let-off control unit 63 resumes the feedback control operation based on the warp tension signal so as to obtain the theoretical let-off rate. It is optional to arrange the let-off control unit 63 so that the feedback control operation is restarted at the end of the first time duration. In this case, a peak appearing at the second time duration T2 is eliminated as shown by a broken line in FIG. 3.

In this way, the control system of this embodiment decreases the warp let-off rate excessively during a limited time duration when the filling density is changed from the low level to the high level. Therefore, this control system can make clear and distinct a boundary in a woven fabric between a low weft density portion and a high weft density portion.

When only the feedback control is used, the boundary between the low and high density portions of the fabric becomes indistinct and vague. In this case, the warp let-off rate is varied only by the feedback control section **63*a*** in accordance with the warp tension signal after the take-up rate is changed to the low speed. Therefore, the warp let-off rate is varied gradually to a new steady state value, and the change in the filling density becomes obscure. Therefore, the control system of the embodiment is arranged to change the filling density more sharply by employing the feedforward control.

There is another cause for indistinctness of density changes. In the boundary between the low density fabric portion and the high density fabric portion, one or more inserted weft yarns slightly escape from the high density portion toward the low density portion, so that the boundary becomes vague. In a woven fabric, each weft yarn is confined between two crossings of overlying warp yarns and underlying warp yarns, but it is slightly movable between the two crossings extending along the weft yarn on both sides. The control system of this embodiment prevent such an escape of the weft yarn by decreasing the warp let-off rate excessively during a limited time duration. Therefore, this control system can make the boundary between different fabric densities clearer.

The control system changes the filling density from the high value to the low value in the following manner. When the fabric take-up rate is returned from the low speed to the high speed corresponding to the low pick density, the warp let-off control unit 63 increases the warp let-off rate to an excessively high value, and holds the let-off rate equal to the excessively high value for a predetermined time duration T3. The change of the warp let-off rate from the low level to the excessively high value is simultaneous with, or in close proximity to, the change of the fabric take-up rate from the low speed to the high speed. The excessively high let-off rate value is a value higher than the theoretical let-off rate value corresponding to the low density value. Preferably, the excess amount obtained by subtracting the theoretical let-off rate value corresponding to the low density value from the excessively high value is greater than 20 percent of the difference between the theoretical values of the high and low densities. Then, the warp let-off control unit 63 decreases the let-off rate from the excessively high value to another temporary value which is slightly lower than the theoretical let-off rate value corresponding to the low density, and holds the let-off rate at this temporary value for a predetermined time duration T4. Thereafter, the control unit 63 controls the warp let-off rate in accordance with the warp tension signal. In this way, this control system can make the change from the high density to the low density, clear and distinct. It is optional to restart the feedback control at the end of the duration T4. The duration T3 of this embodiment has such a length that the machine can weave at least one pick, but cannot weave more than 5 picks.

During the weaving operation, the fabric near the cloth fell is bumping and jolting because of the beating movement of the reed. This bumping movement of the fabric is more severe when the fabric take-up speed is lower. Therefore, when the fabric take-up speed is increased from a low speed to a high speed, the change of the take-up speed is absorbed by this bumping movement of the woven fabric near the cloth fell. As a result, the change in the speed of the warp yarns near the cloth fell is not sharp, and the boundary from the high density to the low density becomes vague. The control system of this embodiment meets this problem by temporarily increasing the warp let-off rate to the excessively high value to promote the forward movement of the weft yarns in the vicinity of the cloth fell.

In this embodiment, the warp let-off control unit 63 changes the warp tension, as shown in FIG. 3. When the weft density is high, the yarns are undulated, and the width of the woven fabric tends to increase. Therefore, this control system increases the warp tension when the density is high, in order to make the fabric width uniform. To do this, the feedback control section **63*a*** of this embodiment is connected with the command section 63c. However, it is optional to hold the warp tension constant irrespective of changes of the filling density.

What is claimed is:

1. A control system of a loom, comprising:

warp transfer means for transferring warp Yarns in said loom, said warp transfer means comprising warp let-off means including first drive means for varying a warp let-off means including first drive means for varying a warp let-off rate, and fabric take-up means including second drive means for changing a fabric take-up rate of said loom to change a filling density of a woven fabric, command means for commanding changes of said filling density in accordance with a preset filling density pattern during a normal weaving operation, and control means for controlling said warp let-off rate and said fabric take-up rate by producing a warp let-off rate control signal representing said warp let-off rate, and a fabric take-up rate control signal representing said fabric take-up rate in such a manner that, each time a change of said filling density is commanded by said command means, said let-off control signal is changed from a current let-off signal value to an excessive let-off signal value at a first instant, said take-up control signal is changed from a current value directly to a new take-up signal value at a second instant, and said let-off control signal is further changed at a third instant from said excessive let-off signal value to a new let-off signal value which is intermediate between said current let-off signal value and said excessive let-off signal value.

2. A control system according to claim 1 wherein said control system further comprises first sensing means for sensing an actual warp tension of said warp yarns, and said control means comprises feedback controlling means for controlling said warp let-off rate so as to reduce a deviation of said actual warp tension sensed by said sensing means, from a predetermined desired warp tension.

3. A control system according to claim 2 wherein said control means further comprises feedforward controlling means for changing said warp let-off rate from a current let-off rate value to an excessive let-off rate value, holding said let-off rate equal to said excessive let-off rate value for a predetermined limited duration, and changing said let-off rate to a new intermediate let-off rate value which is between said current let-off rate value and said excessive let-off rate value when a change of said filling density is commanded, said control means including means for preventing said feedback controlling means from controlling said warp let-off rate for said limited duration.

4. A control system according to claim 3 wherein said control means includes means for changing said let-off control signal and said take up control signal in such a time sequence that said first instant is earlier than said second instant, and said second instant is earlier than said third instant.

5. A control system according to claim 3 wherein said control system further comprises second sensing means for detecting revolutions of a main shaft of said loom to count repetitions of a weaving cycle, and said command means is connected with said second sensing means.

6. A warp transfer control method for changing a filling density during a normal weaving operation of a loom, comprising steps of:

producing a command signal to command a change of said filling density to a new density value, changing a warp let-off rate to an excessive let-off rate value beyond a theoretical let-off rate value corresponding to said new density value upon receipt of said command signal, and holding said warp let-off rate equal to said excessive value for a predetermined limited time duration, changing a fabric take-up rate to a new take-up rate value to change said filling density to said new density value, and varying said warp let-off rate from said excessive let-off value toward said theoretical value after said limited time duration expires.

7. A warp transfer control system for changing a filling density during a normal weaving operation of a loom, comprising;

a warp let-off mechanism including first drive means for varying a warp let-off rate in accordance with a warp let-off rate control signal, a fabric take-up mechanism including second drive means for changing a fabric take-up rate in accordance with a fabric take-up rate control signal, command means for commanding changes of the filling density of a woven fabric in accordance with a preset filling density pattern during the normal weaving operation by producing a command signal to command a change of the filling density to a new density value each time a change of the filling density is required, and control means for producing said warp let-off rate control signal and said fabric take-up rate control signal, said control means including means for changing said warp let-off rate to an excessive let-off rate value beyond a theoretical let-off rate value corresponding to said new density value upon receipt of said command signal, holding said warp let-off rate equal to said excessive value for a predetermined limited time duration, changing said fabric take-up rate to a new take-up rate value to change the filling density to said new density value, and varying said warp let-off rate from said excessive let-off value toward said theoretical value after said limited time duration expires.

8. A control system according to claim 7 wherein said control means includes means for changing said warp let-off rate from a current let-off rate value to said excessive let-off rate value by such an amount of change that said theoretical let-off rate value is intermediate said current let-off rate value and said excessive let-off rate value.

9. A control system according to claim 7 wherein said control means includes means for decreasing said warp let-off rate from said excessive let-off rate value by such an amount that said excessive let-off rate value is lower than said theoretical let-off rate value corresponding to said new filling density value when an increase of the filling density to said new density value is commanded, and increasing said warp let-off rate to said excessive let-off rate value by such an amount that said excessive let-off rate value is higher than said theoretical let-off rate value corresponding to said new density value when a decrease of the filling density to said new density value is commanded.

* * * * *